US008226198B2

(12) United States Patent
Snyder et al.

(10) Patent No.: US 8,226,198 B2
(45) Date of Patent: Jul. 24, 2012

(54) QUIET OPERATING MODE MANAGEMENT SYSTEM FOR A PRINTING DEVICE

(75) Inventors: Trevor James Snyder, Newberg, OR (US); Summer Schneider, Portland, OR (US); Debra Ranee Koehler, Sherwood, OR (US); Jasper Kent Wong, Portland, OR (US); Karen Vicki Zocchi, Beaverton, OR (US); Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 119 days.

(21) Appl. No.: 12/837,491

(22) Filed: Jul. 15, 2010

(65) Prior Publication Data

US 2012/0013667 A1 Jan. 19, 2012

(51) Int. Cl.
*B41J 29/38* (2006.01)

(52) U.S. Cl. ..... 347/16; 347/5

(58) Field of Classification Search ..... 347/16, 347/104, 5
See application file for complete search history.

(56) References Cited

U.S. PATENT DOCUMENTS

| | | | | |
|---|---|---|---|---|
| 6,065,830 | A * | 5/2000 | Hiramatsu et al. | 347/104 |
| 6,256,104 | B1 | 7/2001 | Rumph et al. | |
| 6,375,298 | B2 | 4/2002 | Purcell et al. | |
| 6,977,737 | B2 | 12/2005 | Lea | |
| 7,123,853 | B2 | 10/2006 | Andou | |
| 2005/0030325 | A1 * | 2/2005 | Sugiyama et al. | 347/5 |
| 2007/0144367 | A1 | 6/2007 | Mori | |

* cited by examiner

*Primary Examiner* — Stephen Meier
*Assistant Examiner* — Carlos A Martinez
(74) *Attorney, Agent, or Firm* — Maginot, Moore & Beck, LLP

(57) ABSTRACT

An imaging device includes a quiet mode management system in which a control system of an imaging device selectively reduces print speed based on print job attributes such as job size, repetitions and media in use.

12 Claims, 3 Drawing Sheets

INTELLIGENT QUIET MODE PRODUCT EXAMPLES

| | QUIET PREFERENCE INFLUENCE | |
|---|---|---|
| GENERAL BIAS: | QUIET OPERATION | THROUGHPUT |
| FACTOR | PRODUCT A | PRODUCT B |
| MACHINE STATUS | HIGH | LOW |
| IMAGE SIZE | MODERATE | LOW |
| MEDIA SIZE | LOW | MODERATE |
| STANDARD PAPER | HIGH | LOW |
| ATYPICAL MEDIA | MODERATE | LOW |
| HIGH PAGE COVERAGE | HIGH | MODERATE |
| IMAGE REPETITIONS | HIGH | HIGH |
| IMAGE RIP TIME | HIGH | MODERATE |
| SINGLE JOB, FEW PAGES | YES | HIGH |
| SINGLE MEDIUM JOB | MODERATE | LOW |
| MULTIPLE JOBS IN QUEUE | MODERATE | HIGH |
| STAPLING | N/A | NONE |
| SORTING | N/A | LOW |
| BOOKLET MAKING | N/A | NONE |
| GEOGRAPHY ONE | HIGH | MODERATE |
| GEOGRAPHY TWO | LOW | NONE |
| NOTE: FACTOR PRIORITIES WILL VARY AND MAY CAUSE SOME FACTORS TO BE IGNORED. THIS IS HIGHLY DEPENDENT ON THE PRODUCT AND THE PRODUCT OPTION CONFIGURATION. NOT ALL POSSIBLE FACTORS ARE LISTED. | | |

*FIG. 3*

QUIET OPERATING MODE MANAGEMENT SYSTEM FOR A PRINTING DEVICE

TECHNICAL FIELD

This disclosure relates generally to phase change ink printers, and in particular to methods of operating such printers.

BACKGROUND

Phase change ink imaging products encompass a wide variety of imaging devices, such as inkjet printers, facsimile machines, copiers, and the like, that are configured to utilize phase change ink to form images on recording media. These devices typically include one or more printheads having inkjets configured to eject drops of melted phase change ink using either a direct or an indirect printing process. In a direct printing process, the drops of ink are deposited directly onto recording media by the inkjets. In an indirect printing process, the drops of ink are deposited onto a layer or film of release agent applied to a support surface, such as a rotating drum or belt, and then transferred to recording media by pressing the recording media into the support surface against the ink. The layer of release agent on the support surface prevents the adherence of ink to the support surface while facilitating the transfer of ink to the recording media.

Phase change ink solidifies, or "freezes," rather quickly upon contact with recording media which eliminates the drying time requirement associated with the use of other types of ink, such as aqueous ink. The lack of a drying time requirement enables phase change ink printing devices to achieve relatively high print speeds. Print speed is typically defined as the number of printed pages of a particular type of print job that a printing device is capable of generating in a given time frame, and is a function of characteristics of the ink, the attributes of the print job, and the operating speeds, rates, and frequencies of the various systems and mechanisms of the printing device. Increased print speeds, however, are accompanied by increased sound generation due to the higher operating speeds required of the various systems and mechanisms of a printing device. Because printing devices are often placed in fairly quiet, multi-user office environments, controlling or limiting the sound level generated by these devices is an important design consideration.

One method that is commonly used to reduce sound generation in printing devices is to operate a device at a reduced print speed in what is commonly referred to as a "quiet" operating mode. The reduction in print speed slows the operating speeds of the systems and mechanisms of a printing device which lessens the sound level generated by the device during operation. The quiet operating mode is typically provided as a selectable option capable of being designated by a user, for example, on a job by job basis or for all jobs until disabled.

While effective in reducing noise, previously known "quiet" operating modes may result in the printing device being operated at the same reduced print speed for every print job regardless of the attributes of the print job or the print speed expectations of users associated with the print jobs. In some cases, an operator's expertise must be relied upon to determine when the quiet mode should be enabled or disabled for a printing device. Some operators of a printing device, however, may not be knowledgeable of the effects of different print job attributes on print speeds and sound levels, and/or the sound levels that would be tolerable or intolerable for a given working environment.

SUMMARY

In accordance with the present disclosure, a quiet mode management system for an imaging device has been developed in which the control system of an imaging device selectively slows noise producing dynamic motions for printing operations based on print job attributes such as job size, repetitions and media in use. Job timing relative to standby modes and other printer operation status may further influence calculations that determine when quieter printer operation is implemented. The algorithms controlling operation establish a balance between those jobs likely to be unobtrusive or tolerated when run at a slower, quieter printing speed and those that likely need to run faster.

BRIEF DESCRIPTION OF THE DRAWINGS

FIG. 3 is a table showing factors that may be used to determine a print speed for different print jobs for different implementations of phase change ink imaging device, such as depicted in FIG. 1.

DETAILED DESCRIPTION OF THE PREFERRED EMBODIMENT

Figure 1:
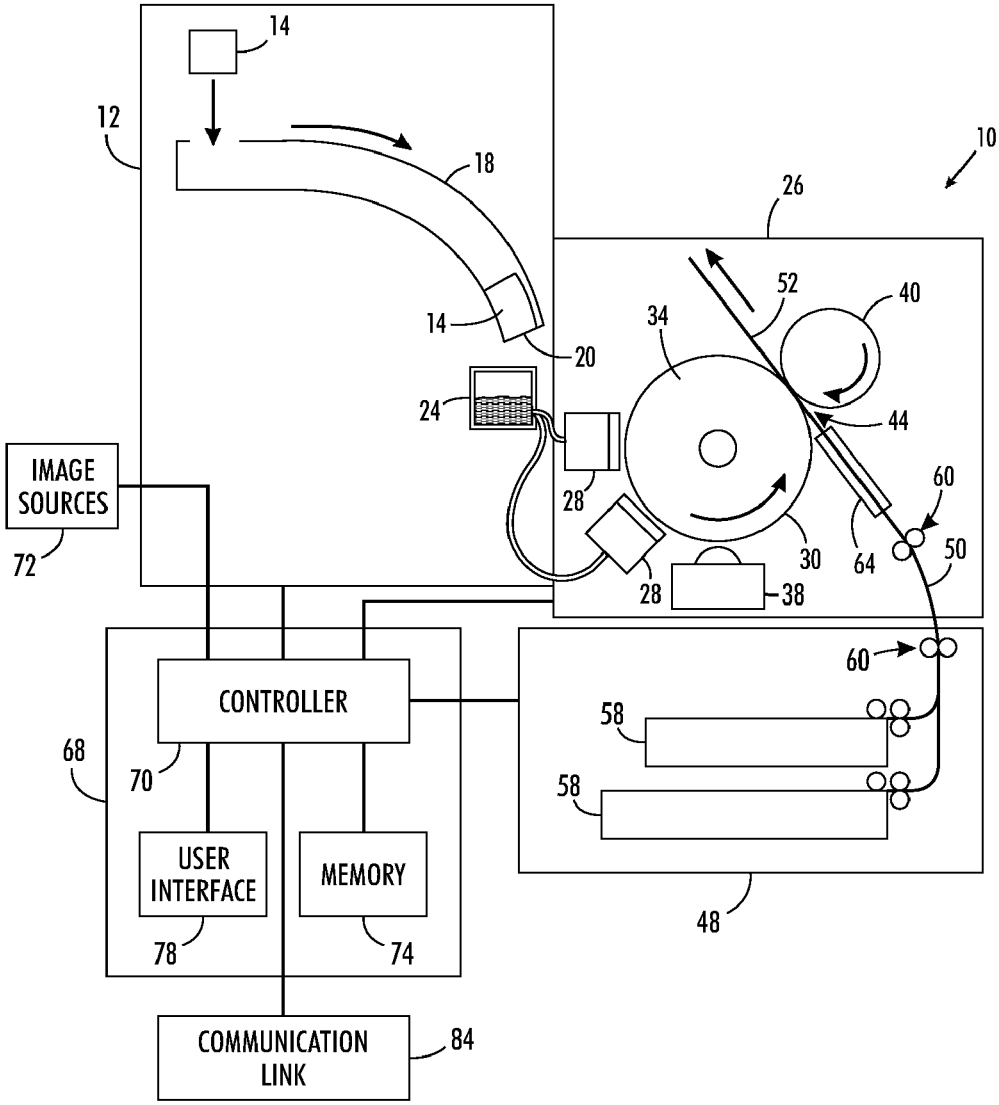
FIG. 1 is a schematic view of an embodiment of a phase change ink imaging device having a control system configured to implement an Intelligent Quiet mode of operation.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" or "recording media" can be a physical sheet of paper, plastic, or other suitable physical print media substrate for images, whether precut or web fed. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

The "print speed" or "operating speed" of an imaging device is defined generally as the number of printed pages of a particular type of print job that a printing device is capable of generating in a given time frame, and is a function of characteristics of the ink, the attributes of the print job, and the operating speeds, rates, and frequencies of the various systems, mechanisms, and functions of the printing device. Terms such as "normal," "standard," and "full" used in reference to the print speed of an imaging device refer to the print speed at which an imaging device is operated when not reduced in accordance with a quiet mode or other mode of operation of the device as described herein, and when not otherwise designated.

Turning now to the drawings, FIG. 1 depicts an embodiment of a phase change ink imaging device 10 capable of being operated at a plurality different print speeds and in a plurality of different operating modes that are associated with the different print speeds. The imaging device 10 includes a control system that enables the selection or activation of the different operating modes of the imaging device 10 and that is configured to control the operating rates of the various components, mechanisms, and functions of the imaging device 10 to cause the device to operate at the print speed(s) associated with the selected or activated operating mode.

As explained below, at least one of the operating modes is referred to herein as an Intelligent Quiet operating mode. When in the Intelligent Quiet operating mode, the control system implements a selection algorithm for automatically (i.e., without user intervention) determining whether a print job should be executed at a normal print speed, or at one or more predetermined slower print speeds that reduce the sound level generated by the device. The intelligent quiet mode is thus a mode of quiet operation managed by a control system and may be referred to as quiet operation mode or simply quiet mode. The selection algorithm takes a number of factors into consideration in making the determination, including but not limited to the number of pages of a job, ink density and/or coverage level, job timing, job origin location, the number of jobs queued, media type and size, finishing function (e.g., stapling and binding), geographic region, type of business, and others, in order to balance the need for quieter operations with the need in some cases for faster print speeds.

FIG. 1 is a side schematic view of an exemplary embodiment of a phase change ink imaging device configured for indirect or offset printing using melted phase change ink. The device 10 of FIG. 1 includes an ink handling system 12, also referred to as an ink loader, that is configured to receive phase change ink in its solid form as blocks of ink 14, referred to as solid ink sticks. The ink loader 12 includes feed channels 18 into which ink sticks 14 are inserted. Although a single feed channel 18 is visible in FIG. 1, the ink loader 12 includes a separate feed channel for each color or shade of ink stick 14 used in the device 10. The feed channel 18 guides ink sticks 14 toward a melting assembly 20 at one end of the channel 18 where the sticks are heated to a phase change ink melting temperature to melt the solid ink to form a molten liquid ink, also referred to as melted ink. Any suitable melting temperature may be used depending on the phase change ink formulation. In one embodiment, the phase change ink melting temperature is approximately 100° C. to 140° C. The melted ink is received in a reservoir 24 configured to maintain a quantity of the melted ink in molten form for delivery to printing system 26 of the device 10.

The printing system 26 includes at least one printhead 28 having inkjets arranged to eject drops of melted ink onto an intermediate surface 30. Two printheads are shown in FIG. 1 although any suitable number of printheads 28 may be used. The intermediate surface 30 comprises a layer or film of release agent applied to a rotating member 34 by the release agent application assembly 38. The rotating member 34 is shown as a drum in FIG. 1 although in alternative embodiments the rotating member 34 may comprise a rotating belt, band, roller or other similar type of structure. A nip roller 40 is loaded against the intermediate surface 30 on rotating member 34 to form a nip 44 through which sheets of recording media 52 are fed in timed registration with the ink drops deposited onto the intermediate surface 30 by the inkjets of the printhead 28. Pressure (and in some cases heat) is generated in the nip 44 that, in conjunction with the release agent that forms the intermediate surface 30, facilitates the transfer of the ink drops from the surface 30 to the recording media 52 while substantially preventing the ink from adhering to the rotating member 34.

The imaging device 10 includes a media supply and handling system 48 that is configured to transport recording media along a media path 50 defined in the device 10 that guides media through the nip 44, where the ink is transferred from the intermediate surface 30 to the recording media 52. The media supply and handling system 48 includes at least one media source 58, such as supply tray 58 for storing and supplying recording media of different types and sizes for the device 10. The media supply and handling system includes suitable mechanisms, such as rollers 60, which may be driven or idle rollers, as well as baffles, deflectors, and the like, for transporting media along the media path 50.

Media conditioning devices may be positioned along the media path 50 for controlling and regulating the temperature of the recording media so that the media arrives at the nip 44 at a suitable temperature to receive the ink from the intermediate surface 30. For example, in the embodiment of FIG. 1, a preheating assembly 64 is provided along the media path 50 for bringing the recording media to an initial predetermined temperature prior to reaching the nip 44. The preheating assembly 64 may rely on contact, radiant, conductive, or convective heat to bring the media to a target preheat temperature, which in one practical embodiment, is in a range of about 30° C. to about 70° C. In alternative embodiments, other thermal conditioning devices may be used along the media path before, during, and after ink has been deposited onto the media for controlling media (and ink) temperatures.

Operation and control of the various subsystems, components and functions of the imaging device 10 are performed with the aid of a control system 68. The control system 68 is operably coupled to receive and manage image data from one or more image sources 72, such as a scanner system or a work station connection, and to generate control signal that are delivered to the components and subsystems based on the image data which causes the components and systems to perform the various procedures and operations for the imaging device 10. The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or microcontroller, configured to execute instructions stored in the memory 74. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 may include a keypad and display (not shown). The controller 70 is operably coupled to user interface 78 to receive signals indicative of selections and other information input to the user interface 78 by a user or operator of the device. Controller 70 is operably coupled to the user interface 78 to display information to a user or operator including selectable options, machine status, consumable status, and the like. The controller 70 may also be coupled to a communication link 84, such as a computer network, for receiving image data and user interaction data from remote locations.

The controller 70 is operably coupled to the various systems and components of the device 10, such as the ink handling system 12, printing system 26, media handing system 48, release agent application assembly 38, media conditioning devices 50, and other devices and mechanisms 80 of the imaging device 10, and is configured to generate control signals that are output to these systems and devices in accordance with the print data and instructions stored in memory 74. The control signals, for example, control the operating speeds, power levels, timing, actuation, and other parameters, of the system components to cause the imaging device 10 to operate in various states, modes, or levels of operation, referred to collectively herein as operating modes. These operating modes include, for example, a startup or warm up mode, shutdown mode, various print modes, maintenance modes, and power saving modes.

Examples of print modes that may be implemented in the imaging device 10 include a standard print mode, photo mode, enhanced mode, fast mode, and quiet mode. Print modes are characterized by the quality of the printed images and/or the speed of image production. In the photo mode, the print image has a higher resolution and higher ink content to provide greater detail and color gamut, while the enhanced and standard modes provide good quality, but, as example, with less resolution and ink pile than photo mode printing. The higher resolution and ink content of photo mode printing results in slower print speeds than standard and enhanced mode printing. The fast mode provides adequate print quality at a level that enables a greater print speed than in standard mode printing.

The imaging device may also have various power saving modes that may be implemented under certain conditions when print jobs are not being executed to reduce power consumption of the imaging device. Examples of power saving modes include standby modes, low power modes, or sleep modes. In a power saving mode, the power levels supplied to the various systems are reduced rather than shutting down the system so that when operations are resumed less time is required to prepare the imaging device for printing. In one embodiment, the controller 70 is configured to monitor usage of the imaging device 10 and ready the device during likely times of imaging device use.

The controller 70 is also configured to generate control signals for the various systems of the device 10 to cause the device to operate in a quiet mode. As used herein, a "quiet mode" refers to a modified operational mode in which the print speed that is utilized to execute a print job may be reduced relative to a print speed that is used to execute the print job under normal operating conditions. Terms used related to a quiet mode, such as Quiet Mode, Intelligent Quite or Quiet Operating Mode, are typically referred to as operation at a reduced speed relative to a normal operation mode but are not limited to speed reduction. Operation in a quiet mode may not be identical to normal operation that just runs slower. All variations of operation that can reduce noise levels are to be encompassed by these terms, including such operation modifications as reduced speed of one or more of a series of actions and even omitting one or more actions, as allowable based on product configuration and performance intent. The controller 70 is configured to enable the quiet mode in response to input received from the user interface 78 or communication link 84. For example, the quiet mode may be provided as a selectable option via the user interface 78 and may be designated by a user on a job by job basis, for all jobs in a given time frame, or for all jobs until disabled. In the quiet mode, the controller causes the components and mechanisms of the systems to operate at a reduced speed relative to the operating speed that would normally be used for a print job which lessens the sound level generated by the device during operation. Examples of components and mechanisms which may be operated at reduced speed or frequency for noise reduction include the rotating member 34, printheads 28, and the drive mechanisms of the media supply and handling system 48, as well as any other suitable motorized and/or driven mechanisms and parts of a print device. The print speed in standard mode may produce approximately 20-40 pages per minute (ppm) depending on the particular attributes of a print job and the printer configuration, as an example. When in the quiet mode, the reduction in print speed may result in a production of approximately 5-20 pages per minute, as example.

The average user predominantly generates print jobs having a low number of pages, e.g., ten or less, where a small increase in time to completion is not particularly noticeable but the reduced level of noise to produce the print is apparent and appreciated. In some cases, however, the preference or need for faster print production may outweigh the preference for quiet operations. For example, the reduction in print speed may increase the time to complete jobs having a high number of pages, e.g., greater than ten, to a degree that becomes unacceptable to some users of a device. Other circumstances in which the preference for faster print speed may outweigh the preference for quiet operations include, for example, print jobs that are executed at times when a user is standing at the device waiting for the print job to be completed, and print jobs that are executed at times that are outside of normal working hours.

If a quiet mode is enabled for all print jobs run by an imaging device, a user may not be given the option to run a print job at normal speed regardless of preference. Even if a quiet mode can be enabled or disabled on a job by job basis, a user may not be knowledgeable of the affects of different print job attributes on print speeds and sound levels, and/or the sound levels that would be tolerable or intolerable for a given working environment.

To address these situations, an imaging device may be configured to operate in a mode in which the print mode or print speed that is used for executing a print job is selected automatically by the control system to balance the preference for faster or normal print production with the preference for quiet operations. In this mode of operation, the controller is configured to selectively slow noise producing dynamic motions for printing operations based on print job attributes such as job size, repetitions and media in use without requiring user intervention. The ability to select the operating mode for executing a print job automatically in this manner establishes a balance between those jobs likely to be unobtrusive or tolerated when run at a slower, quieter printing speed and those that likely need to run faster. Quiet mode operation may involve excluding an action that contributes noticeably to noise level, such as omitting a drum maintenance operation on every other print cycle.

This management of quiet mode activation may be provided as a user selectable option via the user interface 78 similar to the other modes of operation of the imaging device 10. Alternatively, the controller 70 may be configured to receive a command to begin quiet mode management via the communication link 84. The quiet mode management may be provided as an option for a sound control protocol of an imaging device. The sound control protocol may also include a quiet mode override or setting, in which the imaging device always functions in a normal manner, or at normal speed, to maximize throughput. The sound control protocol may also include a persistent quiet mode in which the imaging device is operated in the quietest practical running mode at all times. Selection of the quiet mode management enables the printer to balance normal speed and quiet operation with reference to print attributes and/or status. In a persistent quiet mode, operation settings may be controller managed or varied based on image job content or other influences, as previously described, but would not include reverting to a normal operation mode.

In one embodiment, the controller 70 is configured to manage quiet mode operation by implementing operational mode selection with reference to job type, customer preference, and other print job criteria. Data and instructions for implementing quiet mode operation may be stored in the memory 74 for the controller 70 to access. In one embodiment, the quiet mode management is enabled by establishing at least one set of criteria and attributes for normal print speed jobs and at least one other set of criteria and attributes for reduced print speed jobs. "Normal" print speed refers to the print mode normally used to execute a print job and typically corresponds to the fastest print speed used to execute a print job based on factors, such as the resolution of the print job, ink coverage, media type, and the like, and in general, and can include standard mode, enhanced mode, photo mode, fast mode, or any other print mode utilized in the device 10. The reduced print speed for quiet mode operations may be any suitable print speed. In one embodiment, a single reduced print speed may be used for print jobs that are run in quiet mode. Alternatively, multiple levels of print speed reduction may be used for executing jobs based on different sets of criteria.

In one embodiment, quiet mode management is enabled by establishing a first set of criteria and/or print job attributes for determining which print jobs should be run at normal print speed. The first set of criteria and/or attributes are selected to indicate print jobs having a likely preference for normal speed operations. Examples of print job attributes that may be used to govern normal print operations include print jobs having a predetermined number of pages, e.g., ten or more, print jobs being run outside of normal work hours, low resolution or draft mode, and the like. A second set of criteria and/or print job attributes is established for determining which print jobs should be run at a reduced speed in a quiet mode, and are selected to indicate print jobs that would likely be tolerated when run at the reduced print speed. Examples of print job attributes that may be used for the second set of criteria and/or attributes include print jobs having less than a predetermined number of pages, e.g., five pages or fewer, when the print job is the only job in the queue, print jobs having high resolution and/or coverage, e.g., photo prints. Threshold values for different attributes, such as resolution, coverage, density, page count, and the like, may be predetermined in any suitable manner and stored in the memory 74. One or more print job attributes governing transition from normal print operation may be user selectable, such as being set for quiet mode operation for jobs up to five pages with normal operation at six pages or more. One or more settings may be selectable to conditionally override other quiet mode operation settings, as example, fully eliminating quiet operation during certain hours of the day or specific days of the week.

In addition, a third set of criteria may be established for determining the print speed to utilize with print jobs that do not fall into the first and second set of attributes or to establish a bias for printing either at normal print speeds or at a reduced print speed for print jobs that have criteria and/or attributes that fall into both the first and the second set of criteria and/or attributes. In particular, the third set of criteria and attributes of print jobs is for situations where additional and/or alternate factors are involved and where the thresholds for the first and second categories do not govern operation. Printer operation for jobs in this range may be run for fastest speeds, quietest operation or some intermediate speed to strike a balance between noise level and throughput. Factors that influence operational mode selection and thus the degree of motion control for quieter operation, include medium to high coverage, auto document fed copy jobs, alternate media types and media size, intermediate resolution modes, copy jobs where the user is waiting for output, auto tray fed media vs. media inserted in a manual or bypass tray and other factors that may be applicable, such as option configuration or machine class, sized for tabloid media or those with sorting or finishers, as examples.

Work environment and device type may also be factors utilized for establishing bias for quieter or normal operations. For example, smaller desktop product configurations of medium to low throughput rating are more likely to be placed on or near a desk. These units are most applicable to favoring quiet operation and the selection criteria may be biased for that preference, as referenced in the product A example factor list shown in FIG. 3. Conversely, a high speed A3 or tabloid size MFP having a finisher with hole punch and staple functions is most likely table or floor mounted and used for large jobs and heavy production. Such a product would consequently be centrally placed outside of working cubicles. Noise level is never fully ignorable but print and copy applications for this device most often place a premium on rapid job completion.

In operation, the different sets of criteria and/or attributes may be used by the controller 70 as threshold values for comparison against the criteria and attributes of print jobs as they are received or queued. The controller is able to ascertain relevant print job attributes and criteria in a suitable manner such as by parsing image data to determine page count, ink density/coverage, color content, resolution, and the like, or by monitoring the components and sensors of the systems of the imaging device to determine relevant characteristics, such as job origin location (e.g., at the device, remote job generation, and the like). In addition, criteria such as usage levels during certain times of day may be determined with reference to the operation history as monitored, for example, by the controller. Based on the comparison of the print job criteria and attributes with the first, second, and third sets of criteria and attributes, the controller is able to determine the print speed that a print job is to be run at in order to balance the preferences for faster print speeds with preferences for quiet operations.

Figure 2:
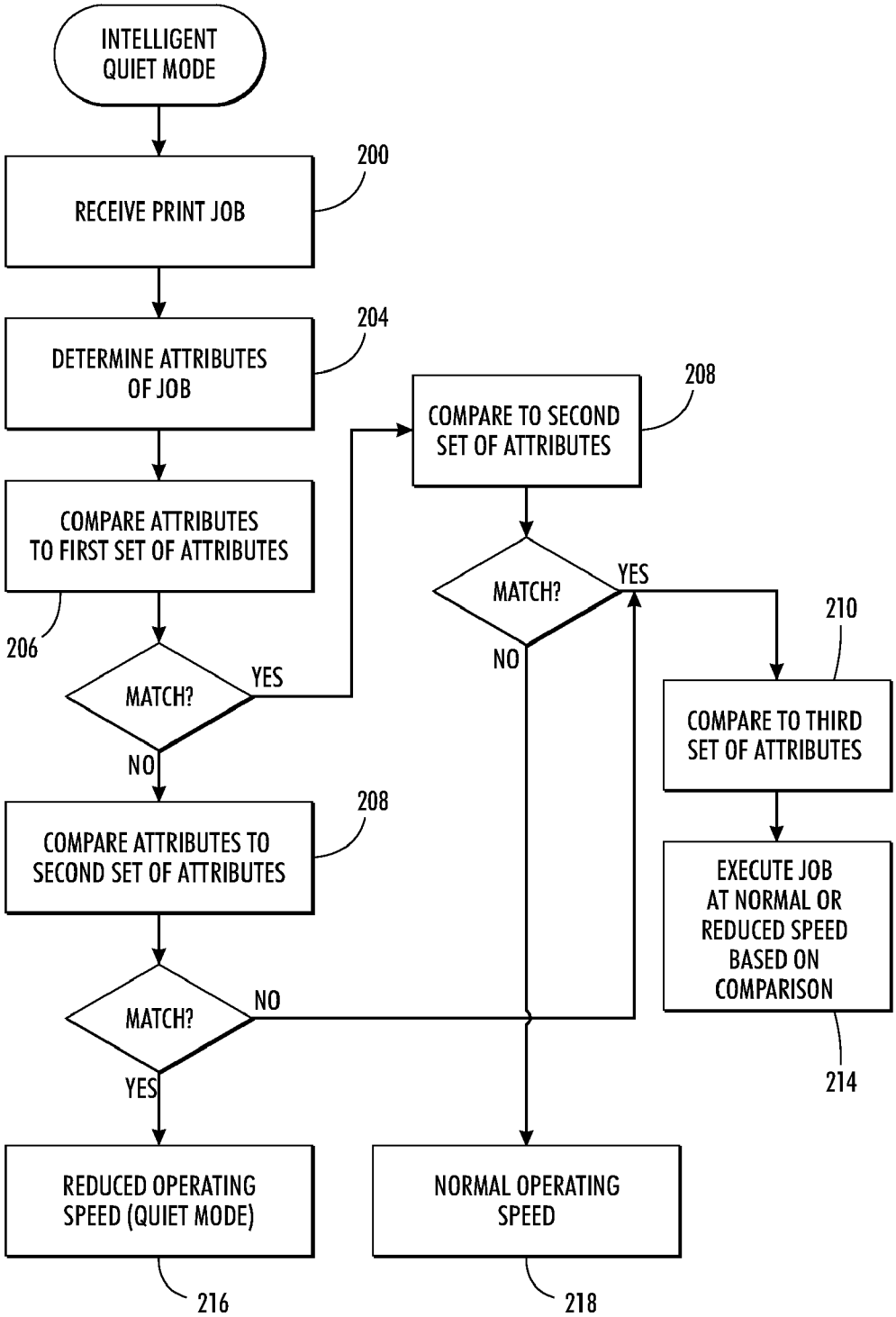
FIG. 2 is a flowchart of an embodiment of a method or algorithm that may be used by the control system of the imaging device of FIG. 1 to determine print speeds for print jobs when in the Intelligent Quiet mode.

A flowchart of an embodiment of a process for implementing quiet mode management in an imaging device is depicted in FIG. 2. As depicted, a print job is received by the controller of an imaging device (block 200). The controller then determines attributes of the print job (block 204). For example, job attributes may be determined by parsing the image data to determine the number of pages, image coverage, density, job origin location, media type, and the like, by receiving option selections via the user interface, by monitoring usage history, or in any other suitable manner. The controller then compares the determined attributes of the print job with the first set of attributes to determine if the print job has a preference for normal print speeds (block 206) and to a second set of attributes to determine if the print job has a preference for quiet operations. (block 208).

If the comparison indicates a preference for normal operating speeds for the job, then the job is executed at the normal operating speed (block 218). If the comparison indicates that the job has a preference for quiet operations, the job is executed at the reduced operating speed in quiet mode (block 216). If the print job attributes do not fall into either the first or second set of attributes or if they fall into both the first and second set of attributes, the controller compares the determined attributes to a third set of criteria to determine whether the print job should be run at normal print speed or at the reduced print speed for quiet operations (block 210). The job is then executed based on the criteria established in the third set of attributes (block 214). For example, the controller is configured to generate control signals that are output to the various systems designating appropriate operating speeds, rates, and frequencies for a given print speed.

In some embodiments, the quiet mode management may allow transitions from, for example, normal print speed operations to reduced speed operations or from reduced print speed operations to normal print speed operations while executing a print job. A print speed transition may be based on incomplete print job information when a print job is initiated. For example, the job size (number of pages) may not be known when imaging starts. Quiet mode management may accommodate that uncertainty by initiating the job in quiet mode and transitioning to faster operation if the job exceeds the quiet mode page threshold. Another example of mode transition is machine state. Slower quiet mode operation may be initially advantageous when transitioning from one of the reduced power consumption states where other factors may cause a shift to throughput preference as the machine becomes fully normalized to an operation state.

Blurring between these levels may result based on combinations of factors and operation parameters so the concept is not specifically a three level segregation. The selection criteria best suited for a desired or most appreciated balance between speed and operation noise level may also vary by product. Numerous configurations and imaging job trends exist between these example extremes. Another factor which may influence the selection criteria implementation is geography. Emphasis on performance in view of typical competitive products and historical preferences may vary by continent or other regional geographic divisions and such preferences may change with time. All these factors make it difficult and impractical to define or limit any particular quiet mode management implementation. No attempt has been made to include all possible factors and any appropriate greater or smaller collection of factors would be consistent with this concept.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those of ordinary skill in the art, which are also intended to be encompassed by the following claims.

What is claimed is:

1. An imaging device comprising:

a media transport system for transporting recording media in an imaging device, the media transport system being configured to operate in a quiet mode in response to a first signal, and in a normal operating mode in response to a second signal, the quiet operating mode being at a reduced print speed relative to the normal operating mode;

a printing system for depositing ink onto the recording media to form images, the printing system being configured to operate in the quiet mode in response to the first signal, and in the normal operating mode in response to the second signal;

a user interface configured to display the quiet mode management as a user selectable option and to enable the selection of the quiet mode management mode by a user;

a controller operatively connected to the media transport system, the user interface, and the printing system, the controller being configured to generate the first signal in response to a print job having attributes associated with the normal operating mode, to generate the second signal in response to a print job having attributes associated with the quiet operating mode, and to generate the first and the second signals in response to the quiet mode management mode being selected by a user with the user interface; and a memory storing data and instructions for access by the controller, the data and instructions defining a first set of attributes associated with the normal operating mode during the quiet mode management, a second set of attributes associated with the quiet operating mode during quiet mode management, and a third set of attributes that enable the controller to determine whether a print job is to be run at the normal operating mode or the quiet operating mode for print jobs having attributes that do not fall into the first and the second set of attributes or for print jobs that have attributes that fall into both the first and the second set of attributes, the attributes of the first, second, and third set of attributes including one or more of a number of pages of a print job, a coverage level of a print job, media type, image resolution, job timing, and job origin location.

2. The imaging device of claim 1, the normal operating mode comprising one of a standard print mode, an enhanced print mode, a photo mode, and a fast mode.

3. The imaging device of claim 1, the first set of attributes including at least one of print jobs having a number of pages greater than a first predetermined number, print jobs generated during times when noise is a consideration, and print jobs having a resolution below a predetermined resolution threshold.

4. The imaging device of claim 3, the second set of attributes including at least one of print jobs having a number of pages less than a second predetermined number, print jobs generated at times when no other print jobs are waiting to be executed, and print jobs having a resolution or coverage level greater than a predetermined threshold.

5. The imaging device of claim 4, the third set of attributes including at least one of job origin location, device type, and work environment type.

6. The imaging device of claim 1, the quiet mode management comprising one of a plurality of sound control modes that include a second mode in which all print jobs are executed using the normal operating mode while the second mode is activated, and a third mode in which all print jobs are executed using the quiet mode.

7. The imaging device of claim 1, the quiet mode management state including user selectable print attribute settings that influence print job execution in one of a normal print mode and a quiet mode.

8. A method of operating an imaging device, the method comprising:

receiving a print job for execution by an imaging device, the imaging device in a quiet mode management state in which print jobs are executed in a normal operating mode in response to a first signal and executed in a quiet operating mode in response to a second signal;

determining attributes of the print job using a controller of the imaging device during quiet mode management;

comparing the determined attributes to a first set of attributes associated with the normal operating mode, to a second set of attributes associated with the quiet operating mode using the controller, and to a third set of criteria to determine whether a print job is to be run at the normal operating mode or the quiet operating mode for print jobs having attributes that do not fall into the first and the second set of attributes or for print jobs that have attributes that fall into both the first and the second set of attributes;

generating one of the first and the second signals in response to the comparison using the controller; and executing the print job in accordance with the generated signal.

9. The method of claim 8 further comprising:

generating the first signal in response to print jobs having a number of pages greater than a first predetermined number, being generated outside normal working hours, or having a resolution below a predetermined resolution threshold; and generating the second signal in response to print jobs having a number of pages less than a second predetermined number, being generated at times when there are no other print jobs waiting to be executed, or having a resolution or coverage level greater than a predetermined threshold.

10. The method of claim 9, further comprising:

providing the quiet mode management as a user selectable option of the imaging device.

11. The method of claim 10, the comparison being performed in accordance with data and instructions stored in memory accessible by the controller, the data and instructions defining the first and the second set of attributes and the operating speed associated with the first and the second set of attributes.

12. The method of 10, the quiet mode management state including user selectable print attribute settings that influence print job execution in one of a normal print mode and a quiet mode.

* * * * *